US009194642B2

(12) United States Patent
Jenkinson

(10) Patent No.: US 9,194,642 B2
(45) Date of Patent: Nov. 24, 2015

(54) PLUG CAPTURE DEVICE

(71) Applicant: Mark Jenkinson, Wilbraham, MA (US)

(72) Inventor: Mark Jenkinson, Wilbraham, MA (US)

(73) Assignee: Present Arms, Inc., Wilbraham, MA (US)

( * ) Notice: Subject to any disclaimer, the term of this patent is extended or adjusted under 35 U.S.C. 154(b) by 0 days.

(21) Appl. No.: 14/462,351

(22) Filed: Aug. 18, 2014

(65) Prior Publication Data

US 2015/0020428 A1 Jan. 22, 2015

Related U.S. Application Data

(63) Continuation-in-part of application No. 13/840,401, filed on Mar. 15, 2013, now abandoned.

(51) Int. Cl.

| | |
|---|---|
| ***F41C 27/00*** | (2006.01) |
| ***F41A 35/00*** | (2006.01) |
| ***F41A 21/00*** | (2006.01) |

(52) U.S. Cl.

CPC ..... *F41A 35/00* (2013.01); *F41A 21/00* (2013.01)

(58) Field of Classification Search

CPC ..... F41C 27/00

See application file for complete search history.

(56) References Cited

U.S. PATENT DOCUMENTS

| | | | | |
|---|---|---|---|---|
| 2,662,437 | A * | 12/1953 | Reynolds | 81/124.3 |
| 4,901,411 | A * | 2/1990 | Chestnut et al. | 42/108 |
| 7,093,520 | B2 * | 8/2006 | Tuanmu | 81/63.1 |
| 7,174,667 | B2 * | 2/2007 | Connal | F41A 35/00 29/270 |
| 7,401,432 | B2 * | 7/2008 | Perry | F41A 11/00 42/108 |
| 8,800,193 | B1 * | 8/2014 | Frear, Jr. | 42/108 |

* cited by examiner

*Primary Examiner* — Reginald Tillman, Jr.

(74) *Attorney, Agent, or Firm* — Antero & Tormey; Pete Tormey; Mike Petrin

(57) ABSTRACT

A device comprising an elongated body having at least one aperture through the body, said aperture silhouetting a barrel bushing for a model 1911 handgun. The device fits snugly and allows the device to operate as a bushing wrench. The aperture may have a longer dimension, said longer dimension substantially perpendicular to the long axis of the elongated body so that the aperture is operable to mate with and operate a barrel bushing. Certain embodiments may include additional openings that silhouette barrel bushings for the same or other firearms or recessed regions on the elongated body adjacent to an aperture that further guide and receive the barrel plug when it is released. The recessed regions may include a ramp section and a plug retention section that act to better hold and guide the barrel plug during removal and insertion operations.

1 Claim, 7 Drawing Sheets

PRIOR ART

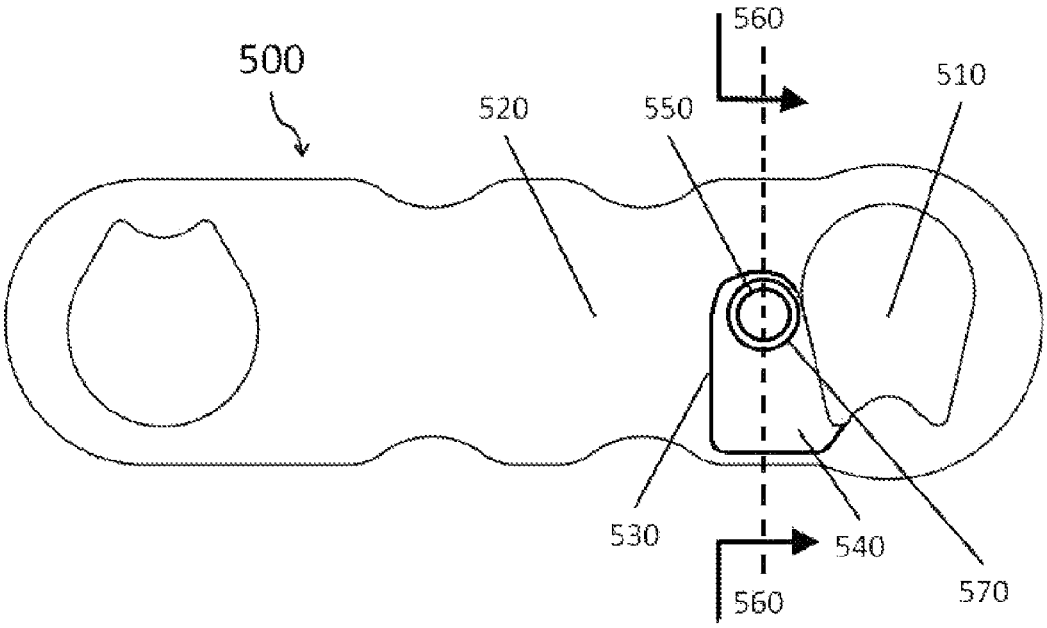
FIG. 5A
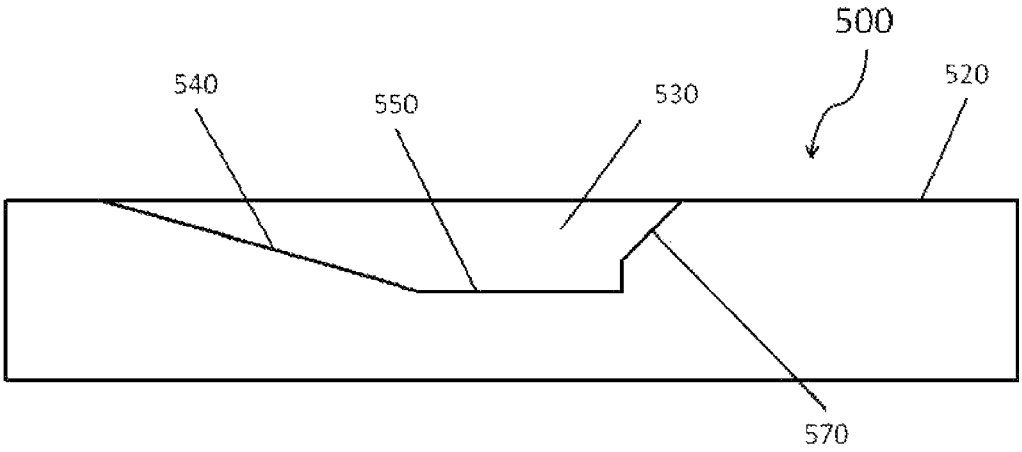
FIG. 5B
FIG. 5

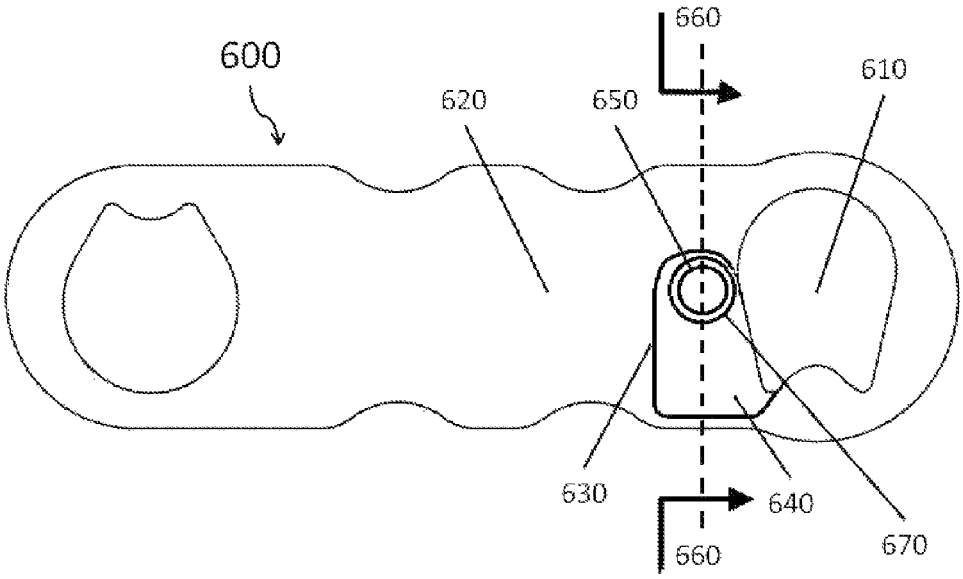
FIG. 6A
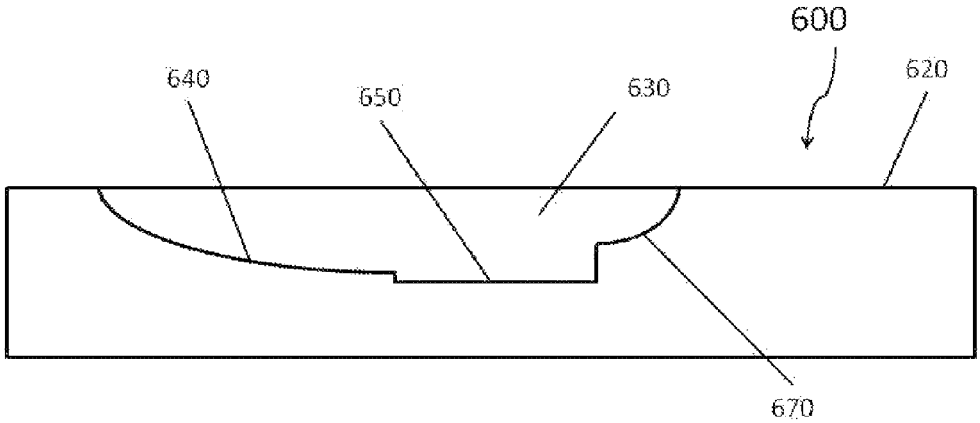
FIG. 6B
FIG. 6

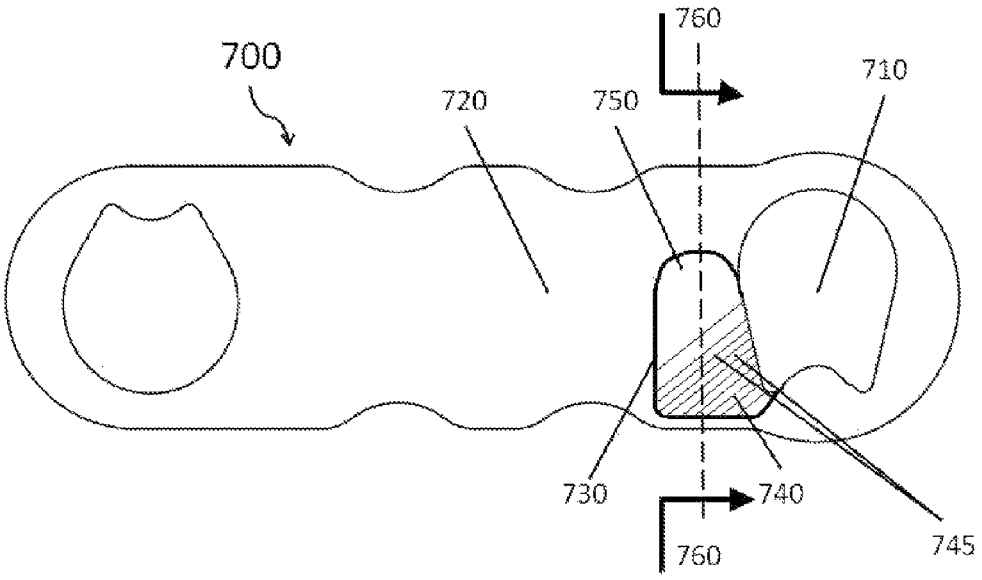
FIG. 7A
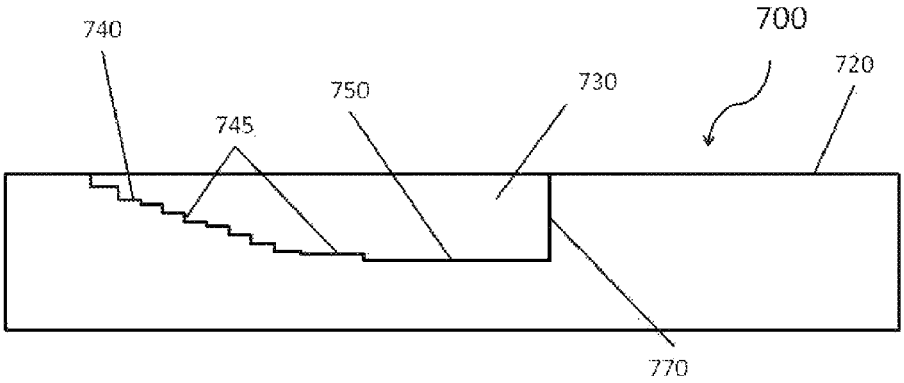
FIG. 7B
FIG. 7

PLUG CAPTURE DEVICE

PRIORITY

This application is a continuation-in-part of co-pending application 13/840,401 entitled "Plug Capture Device" filed Mar. 15, 2013, by the same inventor which, along with their incorporated documents, are incorporated herein by reference as if fully set forth in this disclosure.

BACKGROUND

The present invention relates generally to tools for maintenance and repair of firearms, and more particularly to an improved tool for the safe removal of recoil plugs from handguns.

Certain automatic and semiautomatic firearms such as the Model 1911 handgun include a plug which in turn holds a spring that returns the slide action to position during the recoil phase of firing. The spring is under high tension and may eject the plug inadvertently during disassembly or assembly. This can lead to injuries during disassemble for maintenance of the weapon.

Accordingly there is a need for a better device to assist in the maintenance of certain firearms.

SUMMARY

Disclosed herein are embodiments of devices which may have an elongated body having at least one aperture through the body, said aperture silhouetting a barrel bushing for a model 1911 handgun by being shaped in substantially the same shape as a barrel bushing, but slightly larger to allow it to fit snugly and allow the device to operate as a bushing wrench. The aperture may have a longer dimension, said longer dimension substantially perpendicular to the elongated axis of the body so that the aperture is operable to mate with and operate a barrel bushing. Certain embodiments may include additional openings that silhouette barrel bushings for the same or other firearms.

In operation the device covers the barrel plug of a Model 1911 (or similar) handgun and allows a user to exert a force on the barrel plug. Once the plug is depressed, the device may be used to turn a barrel bushing and release the plug and the spring that the plug holds in place. The device is designed with a barrel silhouette perpendicular to the elongated body so that, while turning the device, the barrel plug will not be ejected.

By way of improvement, the device features a recessed region on the anterior contact side of the elongated body of the device as placed against the outer face of the barrel plug assembly, the recessed region being generally adjacent to the aperture and having a ramp section that transitions to a plug retention section. The recessed region substantially provides a region on the tool where the barrel plug is retained, as it is still under tension from the barrel plug spring and exits the barrel bushing with some outward force that might otherwise cause the device to move or deflect at the moment of release. Accordingly, the recessed region substantially provides a means for the elongated body of the device to engage the tensioned barrel plug after the elongated handle has been turned and the barrel bushing repositioned so as to release the barrel plug and the spring from the barrel of the firearm, the barrel bushing being held in the open aperture of the device when the handle is turned. The recessed region acts in a similar manner during a barrel plug insertion operation as well. The cross-sectional area of the recessed region as projected onto the surface of the anterior surface of the tool substantially includes and may slightly exceed the area that is swept by the circular outline of the protruding end of the barrel plug as the barrel bushing is turned from its starting position, engaged within the aperture of the device, through an approximately ninety (90) degree arc defining a circumscribed path to the final point at which the barrel plug is released as the barrel bushing is turned to a release position.

The volume of the recessed region may include the negative space defined by (a) the approximate and/or integrated area of the region along the circumscribed arc described above, the relative starting position of the recessed region being a point adjacent to the barrel bushing aperture and its relative ending position being a point approximately ninety (90) degrees from the starting position; and (b) the approximate and/or integrated depth of the recessed region over the circumscribed arc or area described above, which increases in depth in some manner (sloped, tapered, stepped, ribbed, patterned, etc.) from the relative starting position of the recessed region to the relative ending position of the recessed region, as defined herein.

The ramp section of the recessed region generally coincides with the edge of the recessed region, and the surface of the ramp section may be ramped, tapered, sloped, and/or a combination thereof with respect to the anterior face of the device; and the surface topography of the ramp section may be patterned in some manner to exhibit a smooth, stepped, ribbed, cross-hatched and/or textured surface feature, and/or a combination thereof. The surface of the ramp section generally increases in depth with respect to the plane of the anterior surface of the elongated body of the device and gradually transitions to the location and the approximate depth of the plug retention section. The ramp section functions to engage the barrel plug as it is released from the barrel bushing, and enables the plug to move outward therefrom without subsequently displacing the wrench. In one embodiment, the ramp section may be configured to smoothly slope away from the anterior surface of the device, essentially featuring a continuously increasing depth relative to the contact side of the tool, which functions to smoothly guide the barrel plug as it is remove or inserted into place, wherein the ramp section terminates by transitioning into the plug retention section. In various other embodiments, the surface topography of the ramp section may be patterned as described above so as to provide better control over the motion of the barrel plug. In yet further embodiments, the surface topography of the ramp section may be patterned to further provide auditory, tactile and/or haptic feedback to the user of the device during operation.

The plug retention section generally begins at the end of the ramp section and/or may transition into the ramp section. In one embodiment, the plug retention section may simply be a flat area at the end of the ramp section. In the simplest of embodiments, the ramp section may terminate at the back wall or terminus of the plug retention section, such that the plug retention section and ramp section are continuous and/or contiguous with respect to each other, and the operable portion of the plug retention section may simply be the wall section only that provides control over the barrel plug. The plug retention section may in another embodiment be a generally flat area at the end of a substantially circular shaped depression having an inner diameter slightly greater than the outer diameter of the barrel plug, thus acting to guide and hold the end of the barrel plug within the substantially circular shaped depression when the tool has fully released the barrel plug. This feature thus acts to control the barrel plug sufficiently so as to prevent its glancing off the anterior surface of the device during removal and flying away, and further serves as a guide for holding the barrel plug in position during installation into the barrel bushing assembly of a firearm when used to reseat the barrel bushing into an operative position.

The construction and method of operation of the invention, however, together with additional objectives and advantages thereof will be best understood from the following description of specific embodiments when read in connection with the accompanying drawings.

BRIEF DESCRIPTION OF THE DRAWINGS

FIG. 5A shows a top view of one embodiment of a plug capture device having an approximately linearly sloped ramp section.

FIG. 5B shows a dotted line representing where a cross-sectional view along a plane perpendicular to the anterior surface of the device.

FIG. 6A shows a top view of one embodiment of a plug capture device having a generally curvilinear sloped ramp section.

FIG. 6B shows a dotted line representing where a cross-sectional view along a plane perpendicular to the anterior surface of the device.

FIG. 7A shows a top view of one embodiment of a plug capture device having step-like surface features on the face of the ramp section.

FIG. 7B shows a dotted line representing where a cross-sectional view along a plane perpendicular to the anterior surface of the device.

DESCRIPTION

Generality of Invention

Figure 1:
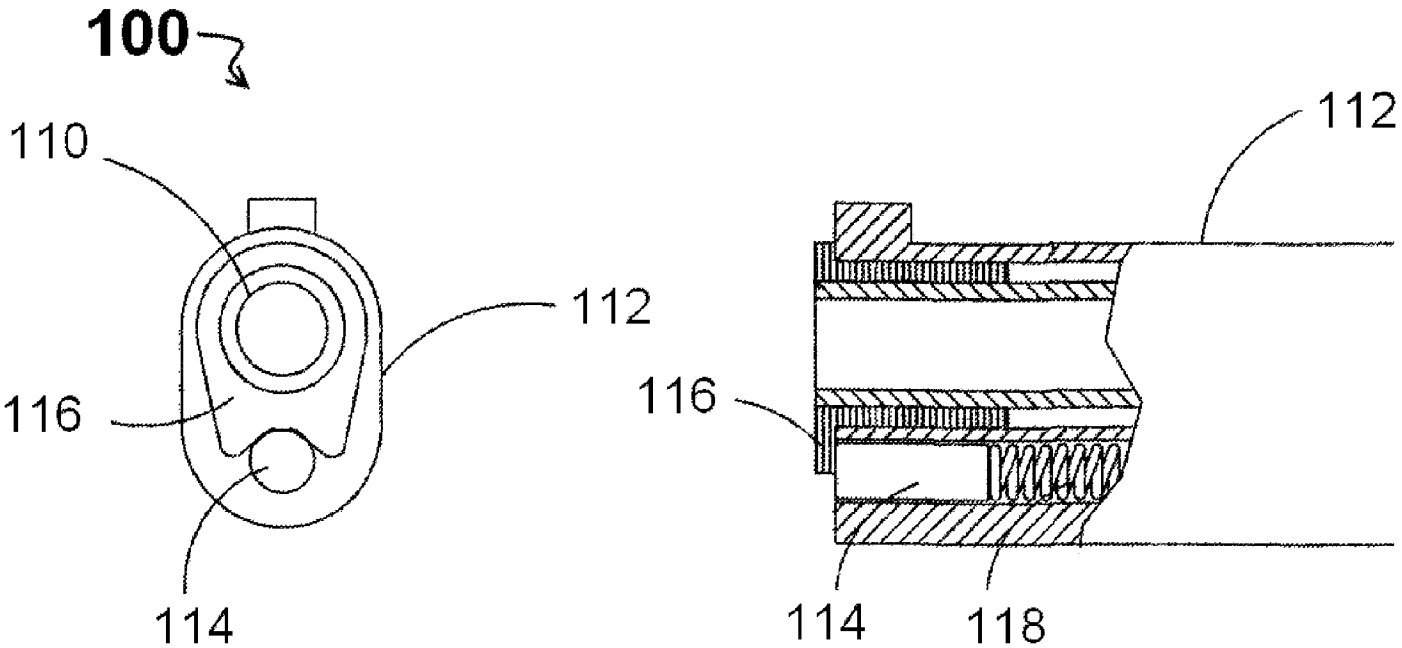
FIG. 1 shows a front and profile image of a model 1911 handgun including a partial break-away view.

This application should be read in the most general possible form. This includes, without limitation, the following:

References to specific techniques include alternative and more general techniques, especially when discussing aspects of the invention, or how the invention might be made or used.

References to "preferred" techniques generally mean that the inventor contemplates using those techniques, and thinks they are best for the intended application. This does not exclude other techniques for the invention, and does not mean that those techniques are necessarily essential or would be preferred in all circumstances.

References to contemplated causes and effects for some implementations do not preclude other causes or effects that might occur in other implementations.

References to reasons for using particular techniques do not preclude other reasons or techniques, even if completely contrary, where circumstances would indicate that the stated reasons or techniques are not as applicable.

Furthermore, the invention is in no way limited to the specifics of any particular embodiments and examples disclosed herein. Many other variations are possible which remain within the content, scope and spirit of the invention, and these variations would become clear to those skilled in the art after perusal of this application.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Read this application with the following terms and phrases in their most general form. The general meaning of each of these terms or phrases is illustrative, not in any way limiting.

Detailed Description

FIG. 1 shows a front and profile image of a model 1911 handgun 100 including a partial break-away view. The model 1911 handgun is shown by way of example only and this disclosure should not in any way be limited to the model 1911. The model 1911 includes a muzzle 110 and a pistol slide 112. A plug 114 is held in place by a bushing 116. The plug 114 and bushing 116 combine secure a spring 118 into the barrel of the piston. Different versions of the model 1911 are made using different shaped bushings.

Conventionally, when the bushing is removed, the plug 114, propelled by the recoil spring 118 is ejected from the barrel. Depending on the force on the spring 118, this ejection may be very rapid and include sufficient energy to cause harm to a person.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
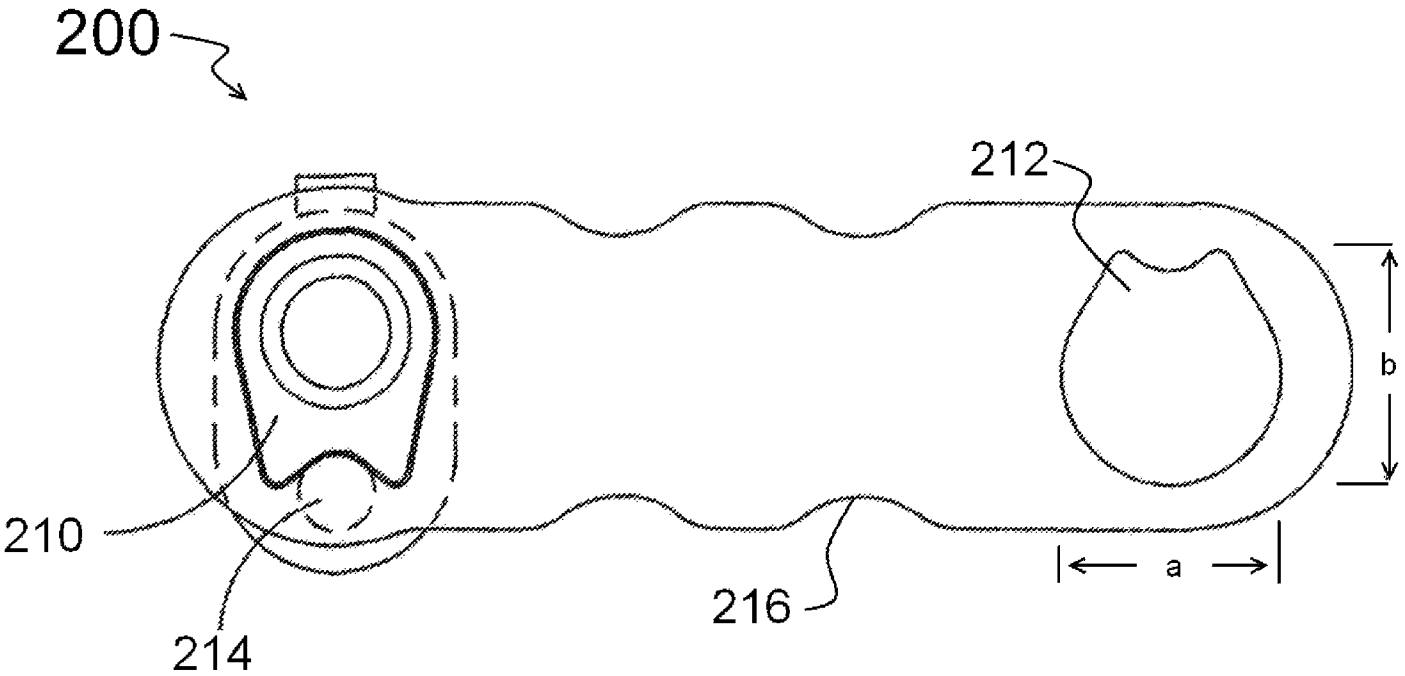
FIG. 2 shows a plug capture device.

FIG. 2 shows a plug capture device 200. The plug capture device has an elongated body along an axis and includes a bushing silhouette 210 formed to fit snugly over a bushing. The bushing silhouettes are openings in the elongated body which are formed to fit snugly over the barrel bushing of a particular firearm. Certain embodiments may include additional silhouettes 212 shaped to snugly fit other types of bushings. As shown in FIG. 2, the silhouette 210 and 212 include a semi-circular area on one portion of the silhouette and a formed portion including curves and indents. The plug capture device 200 has the openings formed to cover the plug 214 on the barrel. The plug capture device may also be formed with one or more indentations 216 to allow for easy gripping the device 200 during operation. The plug capture device 200 has an elongated body with the opening disposed through the body to allow for wrenching (or turning) the bushing and at the same time keeping the device 200 against the plug 214 to prevent its ejection. Accordingly the device 200 is large enough to cover the plug 214 and maintain it in position from the initial process of fitting the device 200 on the bushing, through the entire turning of the bushing. Moreover once the bushing is turned, the device 200 has sufficient girth to maintain the plug in position until a user removes the device 200.

One having skill in the art will recognize that the device 200 may be formed from any suitable material capable of handling the stress of turning a bushing and maintaining a plug in position. This may be metal, plastic or other suitable material. Moreover the silhouettes in the device 200 may be created to match any desirable bushing.

One having skill in the art will appreciate that the silhouettes in the device 200 are formed to allow for providing torque on a bushing. Accordingly a circular opening would be inefficient as lacking any surfaces with which to grasp a bushing. The openings are asymmetrical and have one dimension relatively elongated as compared to the second dimension a. As shown in FIG. 2 the elongated dimension is substantially perpendicular to the elongated axis of the device 200.

Figure 3:
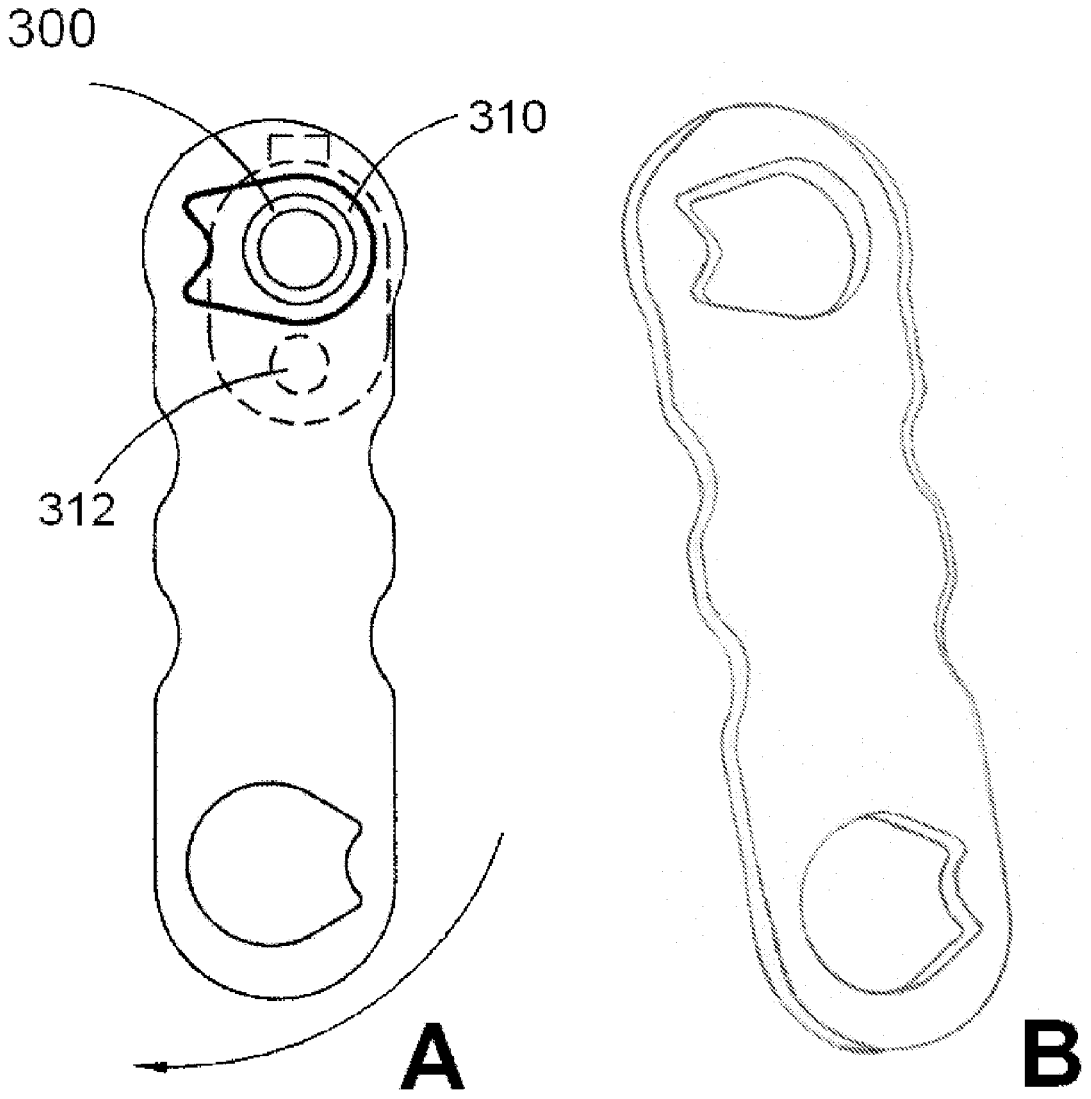
FIG. 3 shows a plug capture device in operation.

FIG. 3 shows a plug capture device 300 in operation. In FIG. 3A a plug capture device 300 has been placed over a bushing such that a silhouette 310 fits snugly over the bushing and the device 300 has been rotated or turned 90 degrees (note arrow). FIG. 3B shows a perspective view of the same plug capture device. In operation depressing the plug 312 while rotating the device 300 unlocks the bushing and allows for rotation of the bushing. The process of turning loosens the bushing and consequently the plug 312 that is held in place by the bushing. FIG. 3 illustrates a significant improvement over conventional barrel bushing tools because in the present disclosure the silhouettes are oriented perpendicular to the axis of the device 300. This allows for complete coverage of the plug 312 through the full arc of rotation of the device 300 without needing to expand the surface area of the device as compared to conventional bushing wrenches.

Despite the improved operation of plug capture device 300 owing to the rotated position of the silhouette 310 with respect to the device's longitudinal access, the barrel plug and spring being under tension when released may sometimes cause the plug to exert a sudden striking force against the plug capture device which can deflect the device at an angle enabling the released plug and spring to glance off the surface of the device and fly free of control.

Figure 4:
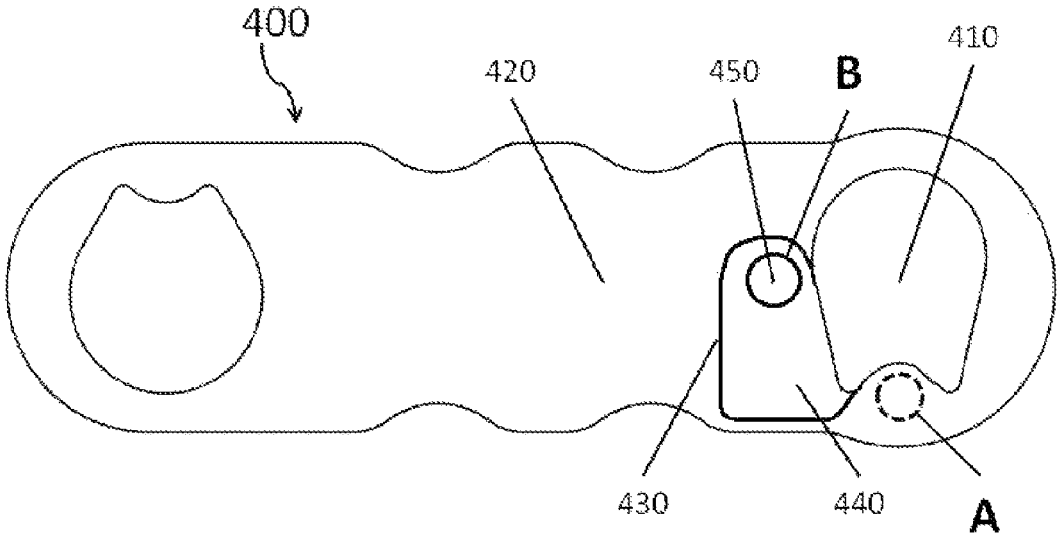
FIG. 4 shows a top view of a plug capture device with a recessed region on the anterior side of the device.

FIG. 4 shows a top view of a plug capture device (400) with a recessed region (430) on the anterior side 420 of the device. FIG. 4 illustrates a plug capture device 400 that features a recessed region 430 adjacent to at least one aperture 410 and located on the anterior side 420 or face of the elongated handle, being the side that engages the silhouette of the barrel bushing and pushes against the face of the barrel plug. The recessed region 430 features a chamfer (or ramp) section 440 and a plug retention section 450 to allow a mechanical transition between the surface of the plug capture device 400 and the surface of the plug retention section 450.

The recessed region 430 provides a region where the barrel plug is retained while it is under tension from the barrel plug spring as it continues to exert outward force that might otherwise cause the elongated handle of the device to move or deflect at the moment of release. Accordingly, the recessed region 430 provides a means for the plug capture device 400 to engage the tensioned barrel plug after the elongated handle has been turned and the barrel bushing repositioned so as to release the barrel plug and the spring from the barrel of the firearm, while the barrel bushing is turned, being held in the open aperture 410 of the device 400. The recessed region's cross-sectional area substantially occupies and may in alternative embodiments be larger than the area that is swept by the circular outline of the protruding end of the barrel plug as the barrel bushing is turned from its starting position at Point A (see FIG. 4), engaged within the aperture of the device, through an approximately ninety (90) degree arc defining a circumscribed path to the final position at Point B, at which point the barrel plug is fully released from the firearm as the barrel bushing is turned to a release position. The recessed region 430 substantially includes the negative space as described herein above, and may in alternative embodiments, be larger than the volume needed to fully accommodate the volume of space swept by the motion of the barrel plug over the ninety degree arc defined by the motion of the elongated handle during a plug removal and/or plug insertion operation.

The relative starting position of the recessed region is point on the region approximately adjacent to the aperture 410 indicated in FIG. 4 as Point A, and its relative ending position is located approximately at or near Point B, the latter point being approximately ninety (90) degrees from the starting position at Point A, the depth of the recessed region 430 decreasing in some manner (sloped, tapered, ramped, etc. with respect to the face of the anterior surface 420 of the elongated handle) from a starting position at or near Point A to an approximate ending position at or near Point B, which is substantially adjacent to the plug retention section 450.

The ramp section 440 of the recessed region 430 generally coincides with the edge or start of the recessed region 430 closest to Point A, and the surface of the ramp section 440 may be ramped, tapered or sloped, and/or a combination thereof so that the surface generally increases in depth with respect to the face of the anterior surface 420 of the elongated body of the device 400, and then substantially transitions to the location and the approximate depth of the plug retention section 450. The ramp section 440 thus functions to engage the barrel plug as it is released from the barrel bushing, and enables it to move outward therefrom without subsequently displacing the device, or flying free of the device.

The plug retention section 450 generally begins approximately at the end of the ramp section and/or substantially transitions into the ramp section 440. In one embodiment, the plug retention section 450 is simply a flat area at the end of the ramp section 440 with sloping walls transitioning between the face of the flat area to the anterior surface 420 of the elongated body of the device 400. The plug retention section 450 may in another embodiment be a substantially flat area at the end of a generally circular shaped depression having an inner diameter slightly greater than the outer diameter of the barrel plug, thus acting to guide and hold the end of the barrel plug within this circular shaped depression when the tool has fully released the barrel plug. This improvement acts to control the barrel plug sufficiently so as to prevent its glancing off the anterior surface of the device during removal and flying away, and further serves as a guide for holding the barrel plug in position during installation into the barrel bushing assembly of a firearm when used to reseat the barrel bushing into an operative position.

FIG. 5A shows a top view of one embodiment of a plug capture device 500 having a recessed region 530, and in which the dotted line 560 represents where a cross-sectional view along a plane perpendicular to the anterior side 520 of the device is shown in FIG. 5B.

FIG. 5B shows one embodiment of the device 500 in which the recessed region 530 features a ramp section 540 that slopes in an approximately linear manner from the anterior side 520 of the elongated handle of the device 500 to the plug retention section 550. In this embodiment, the plug retention section 550 is approximately circular in shape and slightly depressed below the termination point of the ramp section 540 as it transitions to the plug retention section 550. Additionally in some embodiments, the plug retention section 550 may have least a portion of its side (570) opposite to the ramp section 540 tapered or countersunk with respect to the plug retention section 550 and the anterior side 520 of the tool. Optionally, the inner diameter of the plug retention section 550 may slightly exceed, by some desired tolerance, the outer dimension of the barrel plug, so that the latter is retained within the confines of the plug retention section 550. Depending on the size of the respective barrel plug, the tolerance can be between 0.00001 inches to about 0.05 inches, or between about 0.0005 inches to about 0.005 inches, or alternatively between 0.001 inches to 0.01 inches, or yet alternatively sized to be about between about 0.1 to about 10% larger in size than the respective outer diameter of the barrel plug.

FIG. 6A shows a top view of one embodiment of a plug capture device 600 having a sloped ramp section 640, and in which the dotted line represents where a cross-sectional view along a plane perpendicular to the anterior surface 620 of the device is shown in FIG. 6B. FIG. 6B shows one embodiment of the plug capture device 600 in which the recessed region 630 features a ramp section 640 that slopes in an approximately curvilinear manner from the anterior side 620 of the elongated handle of the device 600 to the plug retention section 650. In this embodiment, the plug retention section 650 is approximately circular in shape and slightly depressed below the termination point of the ramp section 640 as it transitions to the plug retention section 650. Additionally in this embodiment, the plug retention section 650 has at least a portion of its side (670) opposite to the ramp section 640 sloped in an approximately curvilinear manner with respect to the plug retention section 650 and the anterior side 620 of the tool. It is to be understood that the ramp section 640 of the device 600 may in other embodiments feature alternative slopes, angles and curvatures that vary the angle and/or slope and/or contour of the surface of the ramp section 620 between a point substantially adjacent to the anterior surface 620 and a point substantially adjacent to the plug retention section 650.

FIG. 7A shows a top view of one embodiment of a plug capture device 700 having step-like features contouring the face of the ramp section 740, and in which the dotted line represents where a cross-sectional view along a plane perpendicular to the anterior side 720 of the device is shown in FIG. 7B. FIG. 7B shows one embodiment of the device 700 in which the recessed region 730 features a ramp section 740 that slopes in a non-linear manner from the anterior side 720 of the elongated handle of the device 700 to the plug retention section 750, but which slope has step-like features resembling steps (745) on its face. In this embodiment, the turning of the elongated body of the device 700 when engaged with a barrel bushing enables the barrel plug to push outward under spring tension against the anterior side 720 of the device 700; and upon further turning of the device, enables the barrel plug to enter the ramp section 740 at the start of the steps 745 at a position substantially adjacent to the beginning of the recessed region 730 and to then strike the anterior facing side of at least one step 745, which holds the plug in position while under spring tension opposed by pressure exerted upon the device 700 by the user, while operating the device. Upon further turning of the device 700, the barrel plug sweeps across the steps 745 of the ramp section 740 and periodically clears each succeeding step and rebounds further outward, which is to say further into the recessed region 730; and then strikes the anterior facing side of a next step of steps 745, and so forth until the end of the barrel plug clears all of the steps 745 and enters into the plug retention section.

The sequentially release, rebound and striking of the barrel plug against each successive step of the plurality of steps 745 results in a sensory feedback event; being either one of, or both, of a sound emanating from and/or a vibration produced in the elongated handle of the device 700 which is communicated to the user either aurally and/or tactilely, respectively, or both. When both sources of sensory feedback events are produced, this results in a haptic sensory feedback event to the user of said device. Exemplary audible or aural feedback events include a click, clack, tick, snap, bang, musical note, and/or a combination thereof, or any desired sound that can be produced by selective modifications with respect to patterning the surface topography of the ramp section 740 to produce such sound.

Exemplary vibrational and/or tactile events may include a motion imparted to the device selected from a jog, jolt, jump, jerk, jiggle, shake, spacial displacement, and/or a combination thereof. In other embodiments, the slope and surface features and topography of the ramp section 740 may be contoured to produce a desired auditory, tactile or haptic feedback event to assist the user of the tool in its operation during the removal or insertion of a barrel plug of a firearm. In additional embodiments, a plurality of spaced protrusions and/or indentations on the surface of the ramp section 740 may be employed in a similar manner to produce a desired sound and/or signature vibrational feedback event.

Indicia

Some embodiments described herein may have an indicia located on the body. This indicia may indicate proper operation of the device or include a logo or other information. For example and without limitation an indicia on one or both of an anterior and/or posterior side of the elongated body corresponding to the aperture to be used for operating a barrel bushing. The indicia communicates to the user the proper placement of the anterior side of the body so as to oppose the face of the barrel plug assembly when the aperture mates with a barrel bushing, so that the recessed region is positioned so as to engage said barrel plug during an insertion and/or removal operation. The indicia may be attached to the body or alternatively engraved, stamp and the like.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A device including:

an elongated body, said body having a proximal and distal end;

a first aperture dispose near the proximal end, said first aperture including a substantially semi-circular portion;

a second aperture, said second aperture including a substantially semi-circular portion, said second aperture disposed near the distal end;

a first recess region disposed adjacent to the first aperture, said recess region including a ramp region, and a second recess region disposed adjacent to the second aperture, said second recess region including a ramp area, wherein said first and second apertures substantially conform to a Model 1911 barrel bushing.

* * * * *